US008349398B2

(12) United States Patent
Choi et al.

(10) Patent No.: US 8,349,398 B2
(45) Date of Patent: Jan. 8, 2013

(54) NORMAL PRESSURE AEROSOL SPRAY APPARATUS AND METHOD OF FORMING A FILM USING THE SAME

(75) Inventors: Hee-Sung Choi, Suwon-si (KR); Kwang-Su Kim, Seoul (KR); Hoo-Mi Choi, Busan (KR); Tae-Sung Kim, Suwon-si (KR); Mi-Yang Kim, Suwon-si (KR); Hyun-Ho Shin, Suwon-si (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 235 days.

(21) Appl. No.: 12/473,560

(22) Filed: May 28, 2009

(65) Prior Publication Data

US 2009/0298251 A1 Dec. 3, 2009

(30) Foreign Application Priority Data

Jun. 2, 2008 (KR) ..... 10-2008-0051828
Nov. 10, 2008 (KR) ..... 10-2008-0111206

(51) Int. Cl.
*B05C 11/10* (2006.01)

(52) U.S. Cl. ..... 427/185; 427/427.2; 118/668; 118/669; 118/677; 118/301; 118/308

(58) Field of Classification Search ..... 118/301, 118/308, 668, 669, 677; 427/185, 427.2
See application file for complete search history.

(56) References Cited

U.S. PATENT DOCUMENTS

2006/0102074 A1* 5/2006 Hatono et al. ..... 118/663
2006/0201419 A1* 9/2006 Akedo et al. ..... 118/308

FOREIGN PATENT DOCUMENTS

JP 2006-291332 10/2006
JP 2007-197795 8/2007
JP 2007-246937 9/2007

OTHER PUBLICATIONS

Translation of JP 2007-246937A. Published Sep. 27, 2007.*
Chinese Office Action, with English Translation, issued in Chinese Patent Application No. 200910143087.7, mailed Aug. 8, 2011.
Japanese Office Action, with partial English Translation, issued in Japanese Patent Application No. 2009-132281, dated Jun. 28, 2011.
English version of Chinese Office Action issued in application No. 200910143087.7 issued on May 28, 2012.

* cited by examiner

*Primary Examiner* — George Koch
(74) *Attorney, Agent, or Firm* — McDermott Will & Emery LLP

(57) ABSTRACT

An aerosol spray apparatus and a method of forming a film using the aerosol spray apparatus are disclosed. The aerosol spray apparatus in accordance with an embodiment of the present invention includes: a carrier gas injection unit, which forms carrier gas by vaporizing liquefied gas and increases the pressure of the carrier gas; an aerosol forming unit, which forms an aerosol by mixing the carrier gas with powder; and a film forming unit, which sprays the aerosol in a normal pressure environment such that the film is formed on the surface of the board. The apparatus can perform a coating process with no restriction of the type and size of powder, simplify the process because the film can be formed in a normal temperature and pressure environment, and control a wide range of film thickness in a short time.

22 Claims, 20 Drawing Sheets

NORMAL PRESSURE AEROSOL SPRAY APPARATUS AND METHOD OF FORMING A FILM USING THE SAME

CROSS-REFERENCE TO RELATED APPLICATIONS

This application claims the benefit of Korean Patent Applications No. 10-2008-0051828, and No. 10-2008-0111206, filed with the Korean Intellectual Property Office on Jun. 2, 2008, and Nov. 10, 2008, respectively, the disclosures of which are incorporated herein by reference in their entirety.

BACKGROUND

1. Technical Field

The present invention relates to an aerosol spray apparatus and a method of forming a film using the aerosol spray apparatus.

2. Description of the Related Art

A conventional powder spraying process uses a method, in which powder is deformed by plastic deformation and the contact between them is tighter by melting the powder in a high-temperature, high-pressure environment, or by using a large impulse being generated when the powder strikes a board. This method has been applied to a structure, such as a ship and an automobile, and a coating on both the inner and outer surfaces of a tube, so as to improve the abrasion resistance and thermal endurance.

A research is currently underway to apply the powder spraying process to electronic components. Particularly, a variety of attempts have led to new applications that may be used for film formation on a board and chip manufacturing, which are key technologies for smaller size.

A coating layer formed by the conventional physical vapor deposition (PVD) or chemical vapor deposition (CVD), which are well-known thin-film processes, has a tendency to crack or delamination when the layer's thickness becomes at least a few micrometers.

On the other hand, a thermal spraying process can provide a coating with a thickness of at least a few hundreds micrometers at high speeds. However, pores may occur in a coating layer. Furthermore, some of potential problems with the thermal spraying process are as follows: particles may be vaporized or the chemical composition thereof may be changed while being exposed to high temperatures, an amorphous mass may be formed due to rapid cooling of the particles, there may be cracks formed on a surface of the coating layer, and adhesion between the coating layer and a board may be decreased. Although the thermal spraying process can provide a thick coating at high speeds, it still has some drawbacks, in which it is hard to control the coating thickness and the coating is rough.

A potential problem with an electrostatic powder impact deposition (EPID) process is that particles, such as carbons and metal particles, which are easily charged electrically, can be coated only and other particles, for example, ceramic particles, cannot be coated. Although this process may provide a coating with a thickness of a few micrometers, it may not be able to produce a coating with a thickness of a few tens micrometers. Moreover, the coating layer is formed with a crystalloid mass that is different from an amorphous mass and raw powder.

If the microstructure of a coating layer formed in a gas deposition (GD) process is examined, it may be noticed that nano-particles used as raw powder are stacked and deposited, and thus using ultrafine particles can be a key technical factor.

However, since metal ultrafine particles are easily oxidized, an additional process is required. Nevertheless, it is hard to maintain the desired degree of vacuum and check the purity of the gas being used, during the raw material preparation process and coating process.

As alternatives to the conventional processes described above, a cold spray process and an aerosol deposition process may solve the potential problems caused by the thermal spraying process. However, these processes still have a drawback, in which a thin board or chip may not be implemented due to the large impulse being generated when the powder strikes the board.

Furthermore, due to the closed system in a low-temperature environment, the flexibility and economy of the process may be degraded. Moreover, the process may be limited since there are restrictions on the type and size of powder being used and the size of diameter, depending on powder injection methods.

SUMMARY

The present invention provides an aerosol spray apparatus and a method of forming a film using the aerosol spray apparatus that can perform a coating process with no restriction of the type and size of powder, simplify the process because the film can be formed in a normal temperature and pressure environment, and control a wide range of film thickness in a short time.

An aspect of the present invention provides an aerosol spray apparatus. The aerosol spray apparatus for forming a film on a surface of a board in accordance with an embodiment of the present invention can include a carrier gas injection unit, which forms carrier gas by vaporizing liquefied gas and increases the pressure of the carrier gas, an aerosol forming unit, which forms an aerosol by mixing the carrier gas with powder, and a film forming unit, which sprays the aerosol in a normal pressure environment such that the film is formed on the surface of the board.

The aerosol spray apparatus can further include a heating unit, which is interposed between the aerosol forming unit and the film forming unit and increases the temperature of the aerosol supplied from the aerosol forming unit.

The liquefied gas can consist of any one of nitrogen and inert gas, and the carrier gas injection unit can maintain a pressure range of the carrier gas between 1 atm and 7 atm.

The aerosol forming unit can further include a powder supply device, which supplies the powder, a gas control valve, which controls an influx of the carrier gas being supplied to the powder supply device, and a powder control valve, which controls the powder being sprayed from the powder supply device. Here, the aerosol forming unit can further include a bypass valve, which discharges remaining powder and impurities of the aerosol forming unit.

The film forming unit can include a chamber, a spray unit, which is mounted inside the chamber and sprays the aerosol, and a position control unit, which controls a position of a board and in which the aerosol sprayed from the spray unit is deposited on the position of the board.

The aerosol spray apparatus can further include a hot plate, which is coupled to the position control unit and in which the board is mounted on the hot plate. The spray unit can be a nozzle orifice with a diameter of 1.0 to 4.5 mm. Here, the spray speed of the spray unit can be determined by the size of the nozzle orifice and the pressure of the carrier gas injection unit.

Another aspect of the present invention provides a method of forming a film on a surface of a board. The method in accordance with an embodiment of the present invention can include forming carrier gas by vaporizing liquefied gas, increasing the pressure of the carrier gas, forming an aerosol by mixing the carrier gas with powder, and spraying the aerosol in a normal pressure environment such that the film is formed on the surface of the board.

The method can further include, between the forming of the aerosol and the forming of the film, increasing the temperature of the aerosol.

The liquefied gas can consist of any one of nitrogen and inert gas, and the increasing of the pressure of the carrier gas can be performed such that a pressure range of the carrier gas is maintained between 1 atm and 7 atm.

Yet, another aspect of the present invention provides a method of fabricating a passive device. The method in accordance with an embodiment of the present invention can include preparing a first conductive layer, forming at least any one of a dielectric layer and a resistance layer on the first conductive layer, and forming a second conductive layer on the dielectric layer or resistance layer. Here, the forming of the dielectric layer or resistance layer can include forming carrier gas by vaporizing liquefied gas, increasing the pressure of the carrier gas, forming a first aerosol by mixing the carrier gas with dielectric powder or resistance powder, and spraying the first aerosol onto a surface of the first conductive layer in a normal pressure environment.

The method can further include, after the forming of the first aerosol, increasing the temperature of the first aerosol. The liquefied gas can consist of any one of nitrogen and inert gas.

The preparing of the first conductive layer can include forming carrier gas by vaporizing liquefied gas, increasing the pressure of the carrier gas, forming a second aerosol by mixing the carrier gas with conductive powder, and spraying the second aerosol onto a surface of an insulation board in the normal pressure environment.

Additional aspects and advantages of the present invention will be set forth in unit in the description which follows, and in unit will be obvious from the description, or may be learned by practice of the invention.

DETAILED DESCRIPTION

Figure 1:
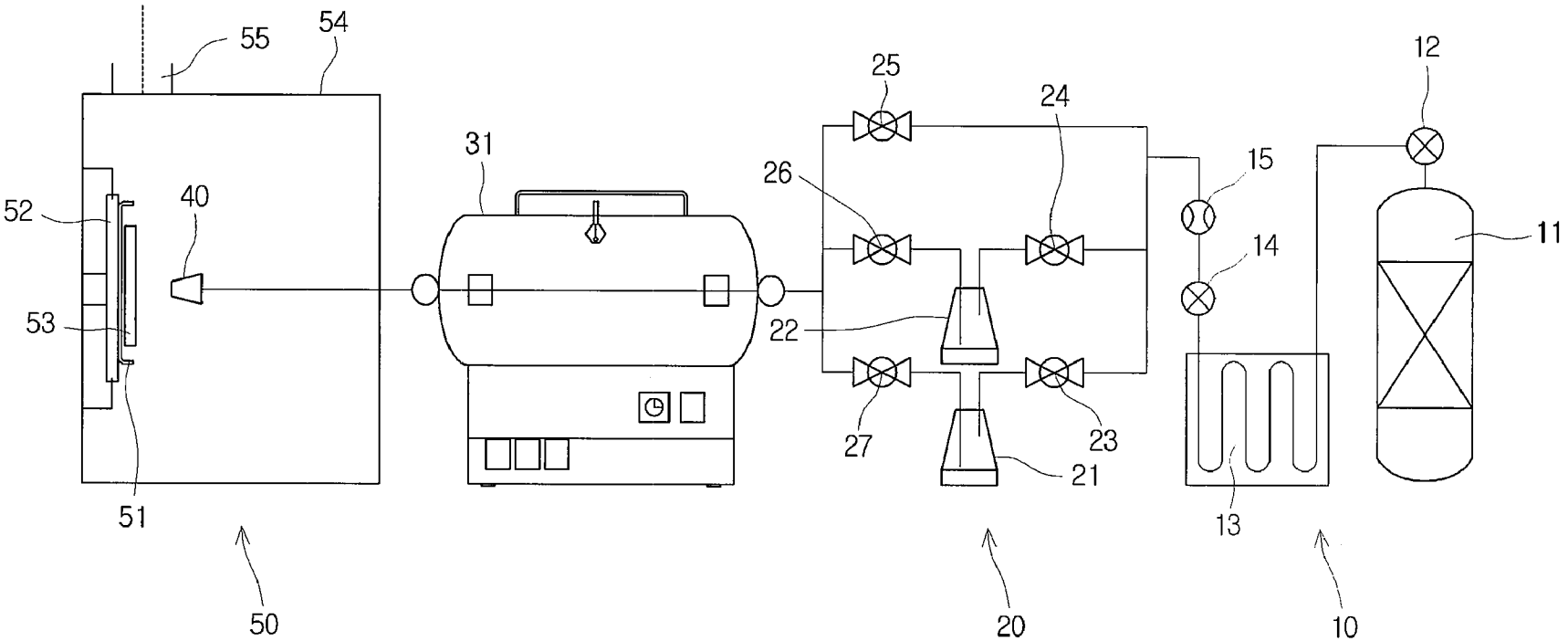
FIG. 1 is a conceptual view of an embodiment of an aerosol spray apparatus in accordance with an aspect of the present invention.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed in the present invention. In the description of the present invention, certain detailed explanations of related art are omitted when it is deemed that they may unnecessarily obscure the essence of the invention.

While such terms as "first" and "second," etc., may be used to describe various components, such components must not be limited to the above terms. The above terms are used only to distinguish one component from another. For example, a first component may be referred to as a second component without departing from the scope of rights of the present invention, and likewise a second component may be referred to as a first component. The term "and/or" encompasses both combinations of the plurality of related items disclosed and any item from among the plurality of related items disclosed.

The terms used in the present specification are merely used to describe particular embodiments, and are not intended to limit the present invention. An expression used in the singular encompasses the expression of the plural, unless it has a clearly different meaning in the context. In the present specification, it is to be understood that the terms such as "including" or "having," etc., are intended to indicate the existence of the features, numbers, steps, actions, components, units, or combinations thereof disclosed in the specification, and are not intended to preclude the possibility that one or more other features, numbers, steps, actions, components, units, or combinations thereof may exist or may be added.

An aerosol spray apparatus and a method of forming a film using the apparatus in accordance with certain embodiments of the invention will be described below in more detail with reference to the accompanying drawings. Those components that are the same or are in correspondence are rendered the same reference numeral regardless of the figure number, and redundant explanations are omitted.

Figure 2:
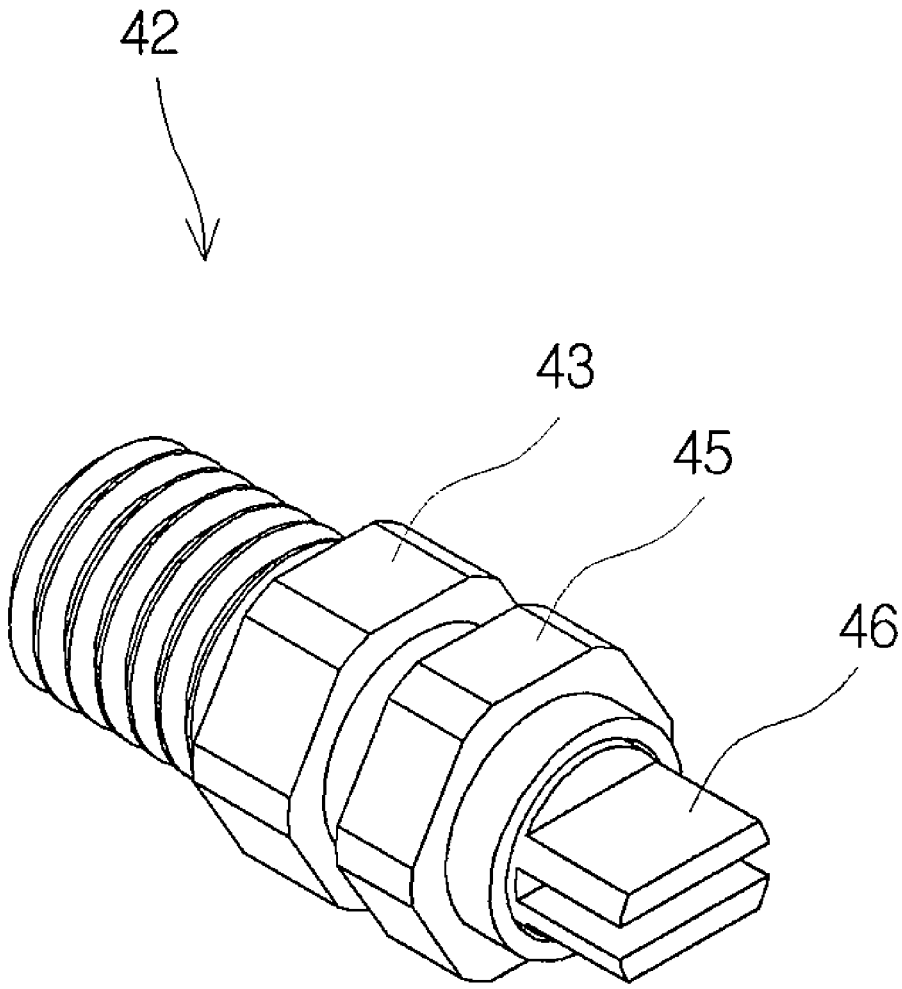
FIG. 2 is a perspective view illustrating a nozzle of a spray unit.
Figure 3:
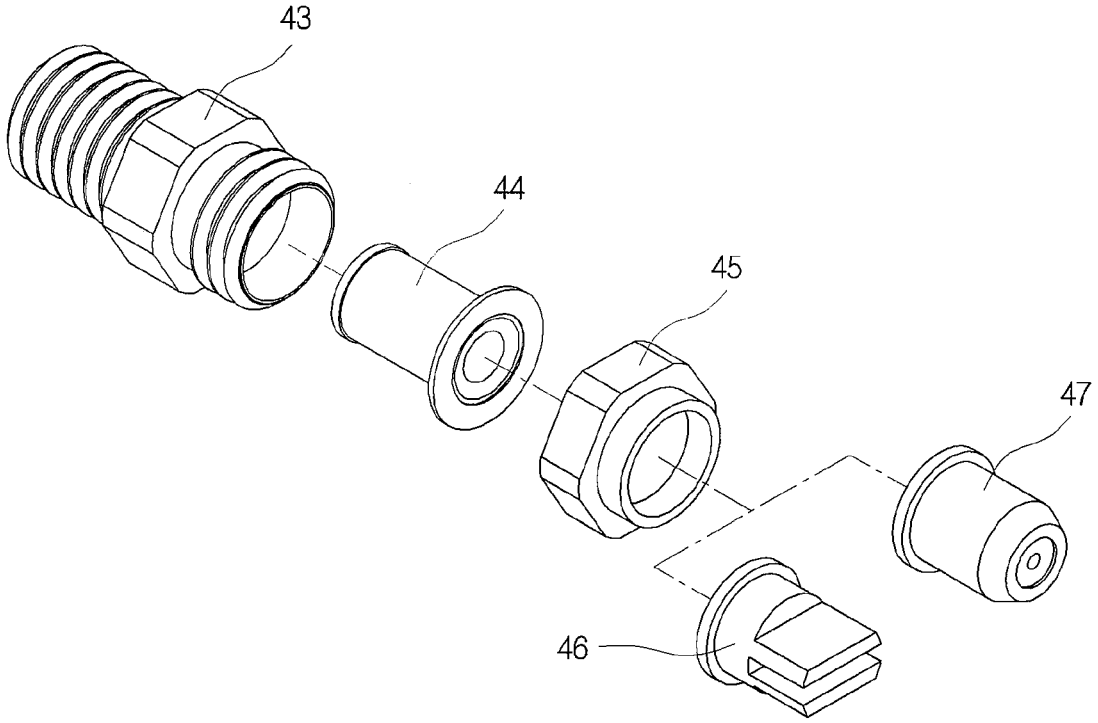
FIG. 3 is an exploded perspective view illustrating a nozzle of a spray unit.
Figure 4:
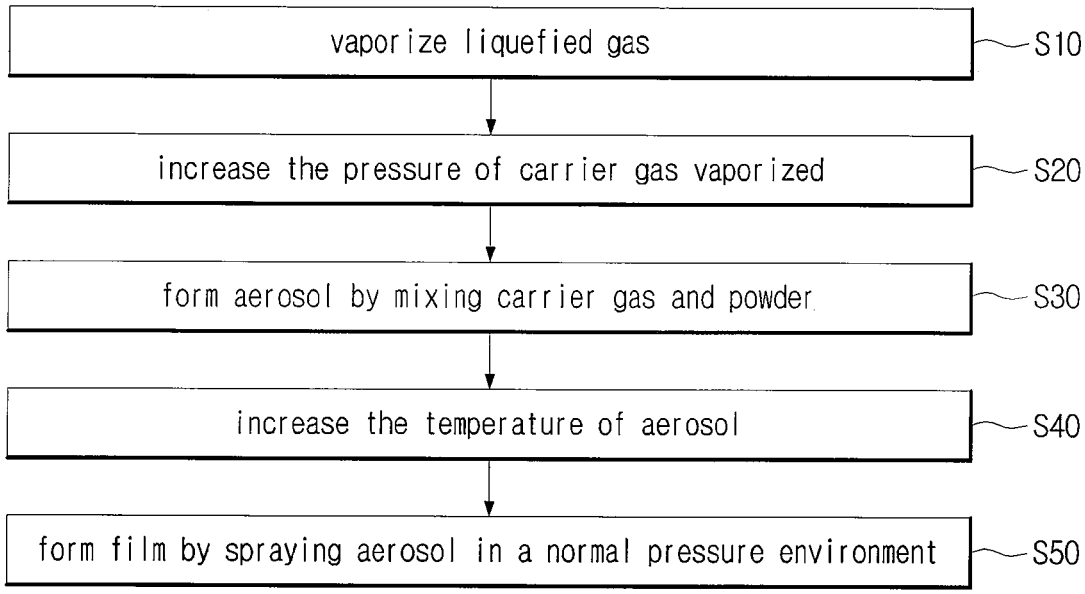
FIG. 4 is a flow chart of an embodiment of a method of forming a film in accordance with another aspect of the present invention.

FIG. 1 is a conceptual view illustrating an aerosol spray apparatus in accordance with an embodiment of the present invention, and FIG. 2 is a perspective view illustrating a nozzle of a spray unit in accordance with an embodiment of the present invention. FIG. 3 is an exploded perspective view illustrating a nozzle of a spray unit in accordance with an embodiment of the present invention, and FIG. 4 is a flow chart illustrating a method of forming a film in accordance with an embodiment of the present invention.

Illustrated in FIGS. 1 to 3 are a carrier gas injection unit 10, liquefied gas 11, regulators 12, 14, a vaporizer 13, a flowmeter 15, an aerosol forming unit 20, a first powder supply device 21, a second powder supply device 22, gas control valves 23 and 24, powder control valves 26 and 27, a bypass valve 25, a heating unit 31, a spray unit 40, a nozzle 42, a body 43, a filter 44, a head 45, a tip 46, a film forming unit 50, a hot plate 51, a position control unit 52, a board 53, a chamber 54 and an exhaust vent 55.

In accordance with an embodiment of the present invention, an aerosol spray apparatus includes a carrier gas injection unit, which forms carrier gas by vaporizing liquefied gas and increases the pressure of the carrier gas, an aerosol forming unit, which forms an aerosol by mixing the carrier gas with powder, and a film forming unit, which sprays the aerosol in a normal pressure environment such that the film is formed on the surface of the board. The aerosol spray apparatus can perform a coating process with no restriction of the type and size of powder, simplify the process because the film can be formed in a normal temperature and pressure environment, easily control the ejecting speed because the speed range of the nozzle being adjustable is wide, and control a wide range of film thickness in a short time.

Furthermore, a coating having a dense structure and electrical properties can be formed by spraying solid-state powder, while using the exit speed due to the shape of a nozzle orifice and a difference in pressure between the carrier gas injection unit and the spray unit in a normal-temperature and normal-pressure environment.

As illustrated in FIG. 1, the present embodiment of the present invention includes the carrier gas injection unit 10, the aerosol forming unit 20, the heating unit 31 and the film forming unit 50.

First, the liquefied gas 11 can be vaporized at the carrier gas injection unit 10 (S10), and then the pressure of carrier gas vaporized can be increased (S20). More particularly, the liquefied gas 11 is injected into the vaporizer 13 in a certain pressurised environment by using the regulator 12. Here, the liquefied gas 11 can consist of nitrogen or inert gas. The liquefied gas 11 of the present embodiment will hereinafter be cited within the description as, for example, liquid nitrogen.

The liquid nitrogen 11 having passed through the vaporizer 13 becomes nitrogen gas having a low-temperature, and can be used as carrier gas. Here, by using the liquid nitrogen 11, powder being used and a coating can be prevented from oxidation. Moreover, the liquid nitrogen 11 is more economical, compared to the nitrogen gas having the same volume as that of the liquid nitrogen 11, because the liquid nitrogen 11 stored in a container that keeps it in a high-pressurised environment can be used by allowing the liquid nitrogen 11 to expand to the desired amount.

The regulator 14 is used to control the pressure of the liquid nitrogen vaporized so that the liquid nitrogen can be sprayed at a desired exit speed. Currently, a pressure range of the carrier gas used in the process is between 1 atm and 7 atm, and the exit speed of the nozzle 42 in the spray unit 40 can be ranged between 100 m/s and 1000 m/s.

The gas flow of the carrier gas passing through a tube can be measured in volumetric flow rates (such as liters per hour) by using the flowmeter 15. Here, the tube used in the system can be made of a stainless material so as to prevent the tube from oxidation.

The conventional cold spray process may require the carrier gas (main gas) to be within a specific pressure range, for example, between 15 atm and 35 atm. However, the process of the present embodiment requires the carrier gas to be within a pressure range between 1 atm and 7 atm.

The aerosol forming unit 20 includes the first powder supply device 21, the second powder supply device 22, the gas control valves 23 and 24, the powder control valves 26 and 27, and the bypass valve 25. The aerosol forming unit 20 forms an aerosol by mixing the carrier gas with the powder (S30).

A certain amount of the powder, which becomes a film, i.e., the coating, is supplied to the first powder supply device 21 and the second powder supply device 22. The powder can consist of any one of metal and nonmetal. The powder of a few tens nanometers to a few tens micrometers can be used in the process.

The metal powder can consist of copper or nickel, and the nonmetal powder can consist of a ceramic material, for example, BT.

The powder becomes an aerosol caused by a pressure difference between the carrier gas being injected and the surrounding pressure at the nozzle 42 of the spray unit 40. Technically, the aerosol is a suspension of fine solid particles, which are between a few hundreds nanometers and a few hundreds micrometers in size, in the carrier gas.

Here, by using the gas control valves 23 and 24, an influx of the carrier gas can pass through or be blocked, and the amount of the carrier gas can be controlled. Moreover, by using the powder control valves 26 and 27, only a desired type of powder can be ejected, or various types of powders can be ejected at the same time by opening all the powder control valves 26 and 27.

When spraying different types of powders at a time, the amount of the carrier gas being injected into the aerosol forming unit 20 can be controlled by using the gas control valves 23 and 24, depending on the properties of the powders.

The bypass valve 25 is constituted by a tube and a ball valve. The bypass valve 25 is used to discharge remaining powder and impurities inside the tube of the aerosol forming unit 20 by supplying the carrier gas, while all ball valves connected to the aerosol forming unit 20 are closed, except the bypass valve 25.

Here, it shall be apparent that the number of the powder supply devices 21 and 22, the gas control valves 23 and 24, and the powder control valves 26 and 27 can be increased, depending on the types of powders required.

According to the present embodiment of the present invention, after connecting at least two powder supply devices 21 and 22 and one bypass valve 25 to the carrier gas supply tubes, the flow of the carrier gas can be controlled by controlling the valve. Thus, without replacing a device or adding an additional separating process, several different types of powders can be ejected.

A film having a thickness of a few micrometers can be formed, and it takes a few minutes to a few tens minutes.

Next, the aerosol generated can be supplied to the heating unit 31 through the powder control valves 26 and 27. Then, the temperature of the aerosol supplied is increased at the heating unit 31 (S40).

The heating unit 31 is an open and close type electric furnace. The heating unit 31 uses a tube having the same diameter as that of the tube used in the system, and uses a tube that can withstand the congestion time taken for a given diameter to reach a certain temperature required to the diameter. Moreover, a tube that can be replaced during the congestion time is used in the electric furnace, and the temperature and time can be controlled.

The temperature inside the electric furnace can be maintained at a constant temperature between 0° C. and 1000° C. The aerosol can be protected from oxidation because it is heated while the electric furnace is completely sealed from the outside air. Due to the increasing temperature of gas, the electric furnace can accelerate the gas to high speed at a relatively low operating pressure.

In the case of the aerosol consisting of metal powder, plastic deformation can easily occur because the temperature of the aerosol is below the melting point. Thus, when the aerosol is ejected onto the board 53, it can be easily coupled to the board 53, and can form a coating with a microstructure.

The film forming unit 50 can spray the aerosol, which has been heated in the heating unit 31, in a normal-temperature, normal-pressure environment, so that a film is formed (S50). The normal pressure aerosol spray method is a normal temperature and normal pressure process, in which a coating can be formed in a simpler configuration and processing condition than the conventional powder spraying process.

In other words, the conventional cold spray process may require a pressure range of the carrier gas (main gas) between 15 atm and 35 atm, but the process of the present embodiment can operate in a pressure range of the carrier gas between 1 atm and 7 atm.

Furthermore, the conventional aerosol deposition process is a closed system that is constituted by two main chambers, which are a powder supply chamber and a deposition chamber. The chambers have a pressure difference of 800 torr and of 1 torr, respectively.

By the pressure difference between them, powder can be accelerated, and a coating can be formed at a low pressure of 1 torr. On the other hand, the process of the present embodiment is an open system, and thus the process can be performed in a normal pressure environment. Therefore, since there is no additional process required for forming a vacuum environment, an additional device is not needed for a vacuum state.

The film forming unit 50 can include the chamber 54, the spray unit 40, the hot plate 51, the position control unit 52 and the exhaust vent 55.

The chamber 54 is shaped like a rectangular parallelepiped, and can recycle powder that is not deposited on the board 53 but thrown out from the board 53 during the spraying process. The chamber can also prevent the powder from oxidation by sealing the chamber from the outside air. Moreover, since the shape of the chamber 54 can affect a flow of gas inside the chamber 54, the design is an important factor.

The spray unit 40 is mounted inside the chamber 54 so as to spray the aerosol. More particularly, the spray unit 40 is configured to as a replaceable type nozzle. As a result, the ejecting speed can be controlled without modifying the process system, by replacing a nozzle orifice having a diameter of 1 to 4.5 mm in accordance with the speed required. Here, the speed required can be ranged between 100 m/s and 1000 m/s.

Since the spraying speed of the aerosol is finely controlled more easily, the following effects can occur. That is, the aerosol spray method has no restriction on the use of metallic or non-metallic powder due to their ease of speed control in comparison with the conventional powder spray method, which has high coating characteristics only if one type of powder, for example, metallic powder or ceramic powder, is used at a time. Moreover, powder with a variety of different diameters ranging from a few tens nanometers to a few tens micrometers can be used.

FIG. 2 is a perspective view illustrating a nozzle of a spray unit in accordance with an embodiment of the present invention, and FIG. 3 is an exploded perspective view illustrating a nozzle of a spray unit in accordance with an embodiment of the present invention.

Illustrated in FIGS. 2 and 3 are the nozzle 42, the body 43, the filter 44, the head 45, the tip 46 and a tip 47.

The body 43 is a coupling unit being coupled to the tube, and can support the nozzle tips 46 and 47. The role of the head 45 is to hold the nozzle tips 46 and 47 in position at the body 43. The nozzle tips 46 and 47, which are main parts of the nozzle 42, can be simply replaced with a required diameter, depending on the conditions, and thus the exit speed at the nozzle exit can be easily controlled without replacing the tube of the system.

The nozzle tips 46 and 47 are flat types of its kind. Especially considering that the shape of a coating being formed is a rectangular shape, the flat type can reduce the amount of powder wasted during the spraying process, and can form an outline of a sophisticated coating.

The size of an orifice of the nozzle 42 is manufactured every 5 mm such that the nozzle orifice is formed with a diameter ranging between 1.0 mm and 4.5 mm. The exit speed is determined by the size of the nozzle orifice and the input pressure of the carrier gas. The interior shape of the nozzle 42 is like a converging nozzle, which has a converging section and in which the area decreases.

While the aerosol is sprayed through the nozzle 42 of the spray unit 40, a film, i.e., the coating, being deposited on the board 53 can be formed.

The board 53, onto which the coating is to be formed, is mounted on top of the hot plate 51, regardless of the types of the board. The temperature controlled hot plate 51 can be controlled between 0° C. and 300° C., and can be controlled to maintain the temperature such that the property of the board 53 is not affected.

The hot plate 51 having the board 53 mounted thereon is coupled to the position control unit 52 that is a x-y-z stage. The position control unit 52 can form a coating with uniform roughness by moving the hot plate 51 having the board 53 mounted thereon in x and y directions at a certain speed.

In addition to the exit speed at the nozzle exit and the spraying time, a distance between the board 53 and the nozzle exit, which is another important factor in the process, can be precisely adjusted in the z direction, forming a coating in accordance with the inertia of different sized particles.

As such, the processing flow and control method of processing conditions for the normal pressure aerosol spray system, which have been described above, will be described hereinafter. The nitrogen 11 is used as the carrier gas so as to prevent the powder from oxidation, and the injected carrier gas is supplied to at least two powder supply devices 21 and 22, and the bypass valve 25, depending on the types of powders required. Here, whether it is supplied or blocked, the gas control valves 23 and 24, and the powder control valves 26 and 27 can be used to control simultaneous supply or individual supply.

The powders inside the powder supply units 21 and 22 become an aerosol due to the pressure difference. The type of powder can be any one of metal and nonmetal, and the diameter thereof can be anywhere between a few tens nanometers and a few tens micrometers.

At this time, the pressure range of the carrier gas is maintained between 1 atm and 7 atm. The aerosol formed through such processes can be heated to temperatures ranging from 0° C. to 1000° C. while passing through the heating unit 31. The heated aerosol can be sprayed through the replaceable nozzle 42, and the nozzle orifice can be ranged in diameter from 1 mm to 4.5 mm.

The speed at the nozzle exit can be determined by the size of the nozzle orifice and the pressure of the carrier gas at the entrance to the carrier gas injection unit 10, and the speed can be ranged from 100 m/s to 1000 m/s. While the aerosol sprayed from the nozzle 42 collides with the board 53, the powder inside the aerosol can form a film. The size of the film and a spraying distance between the board 53 and the nozzle exit can be controlled by the x-y-z stage, i.e., the position control unit 52.

In other words, the purpose of the normal pressure aerosol spray process of the present embodiment is to form a coating with desired electrical properties, thickness and size by controlling the processing conditions, such as the speed of the carrier gas, a spraying distance, spraying time and the types of powders.

A key process to achieve such purpose described above is how to control the speed at the nozzle exit, and the speed can be controlled by the carrier gas injection unit 10 and the spray unit 40. The size and roughness of a coating being formed can be controlled by the film forming unit 50. Moreover, the heating unit 31 can be used to increase the efficiency of forming the coating and improve the physical and organizational property of the coating.

Figure 5A:
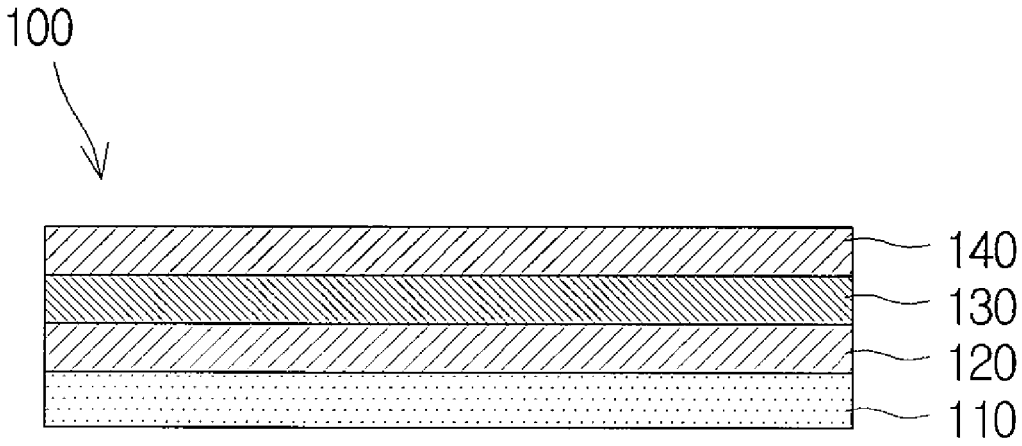
FIGS. 5 to 8 illustrate a method of fabricating a passive device in accordance with yet another aspect of the present invention.
Figure 5B:
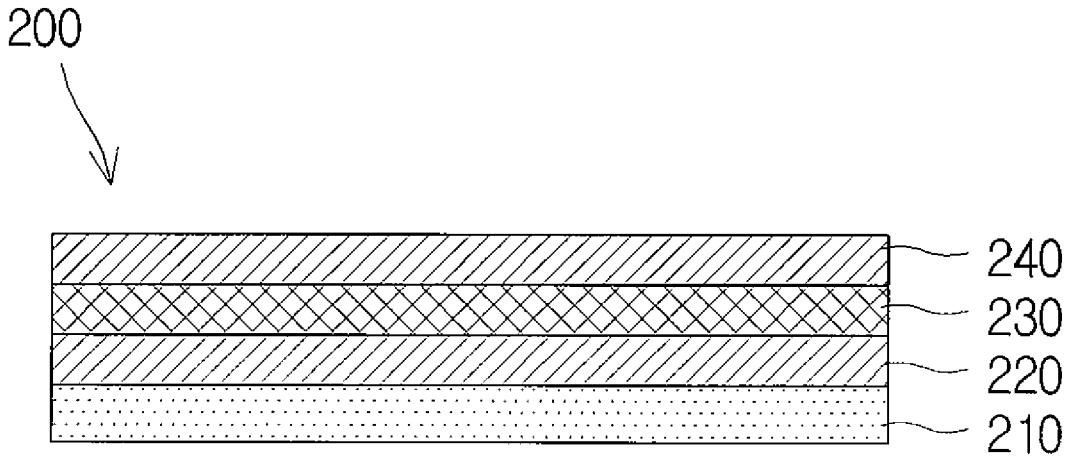
Figure 5C:
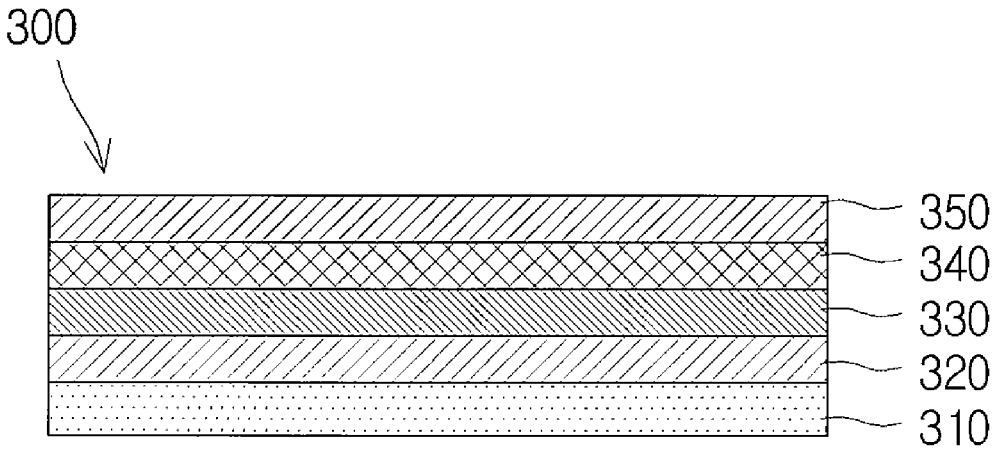

By using the normal pressure aerosol spray system, which has been described above, a passive device, such as an embedded capacitor board 100, an embedded resistor board 200 and an embedded capacitor resistor board 300, can be manufactured on a dielectric board, as illustrated in FIG. 5.

First of all, a method of manufacturing the embedded capacitor board 100 will be briefly described by referring to FIG. 6.

Figure 6A:
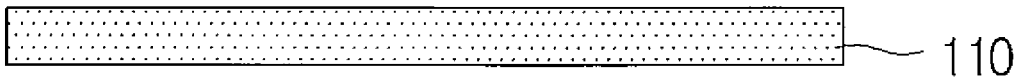

First, an insulation board 110 is prepared, as illustrated in FIG. 6A. A variety of insulation boards, from an insulation board of ceramics, for example, alumina oxides, to an epoxy plastic board charged with glass fibers, can be used as the insulation board 110.

Figure 6B:
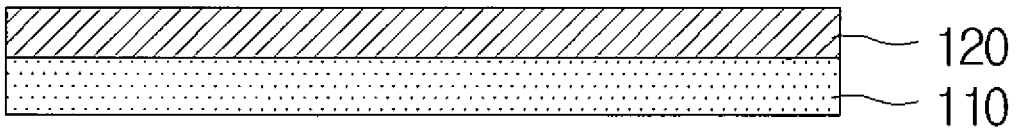

Then, as illustrated in FIG. 6B, a conductive layer 120 is formed on the insulation board 110 by using the normal pressure aerosol spray system described above. Here, copper particles with a diameter of about 5 um can be used to form the conductive layer 120, and it shall be apparent that metal particles having a variety of materials can be used. The conductive layer 120 being formed on the insulation board 110 can be formed in thickness between 1 um and 500 um, depending on the size of metal particles being used.

Figure 6C:
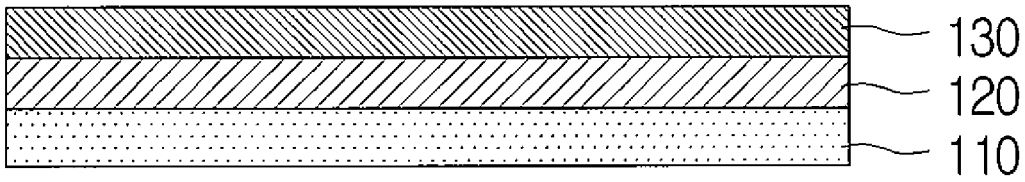

After that, as illustrated in FIG. 6C, a dielectric layer 130 is formed on the conductive layer 120 by using the normal pressure aerosol spray system. In order to form the dielectric layer 130, dielectric particles such as barium titanate particles can be used. In the present embodiment, $BaTiO_3$ particles having an average diameter of about 0.45 um are used. In addition to the above, if necessary, it shall be apparent that a variety of dielectric particles mixed with small amounts of additives can be used. The dielectric layer 130 can be formed in thickness between 1 um and 50 um, depending on the size of the dielectric particles being used and the processing conditions.

Figure 6D:
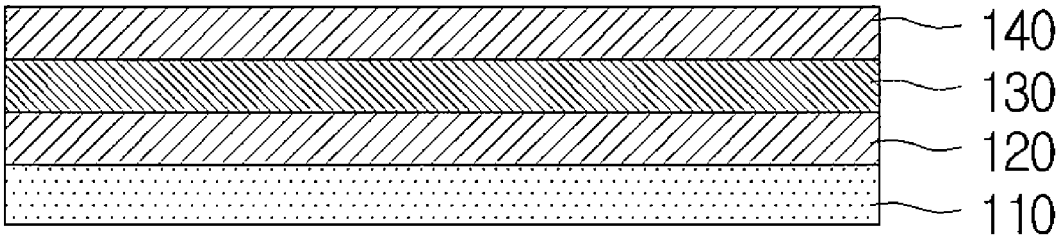

As illustrated in FIG. 6D, a conductive layer 140 can be formed on the dielectric layer 130 so as to manufacture the embedded capacitor board 100. At this time, the normal pressure aerosol spray system can be used for forming the conductive layer 140, and other methods, such as plating or evaporation, can be also used.

Although a method of forming the conductive layer 120 and the dielectric layer 130 is disclosed by using the normal pressure aerosol spray system, as illustrated in FIG. 6, the embedded capacitor board 100 can be also formed by forming a dielectric layer on one surface of a conductive layer, for example, a copper clad laminate, which has been already formed, through the use of the normal pressure aerosol spray system.

Next, a method of manufacturing the embedded resistor board 200 can be briefly described by referring to FIG. 7.

Figure 7A:
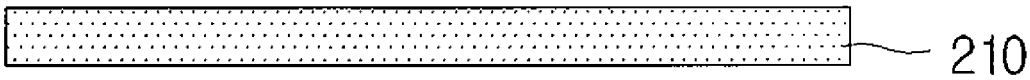

First, an insulation board 210 is prepared, as illustrated in FIG. 7A. A variety of insulation boards, from an insulation board of ceramics, for example, alumina oxides, to an epoxy plastic board charged with glass fibers, can be used as the insulation board 210.

Figure 7B:
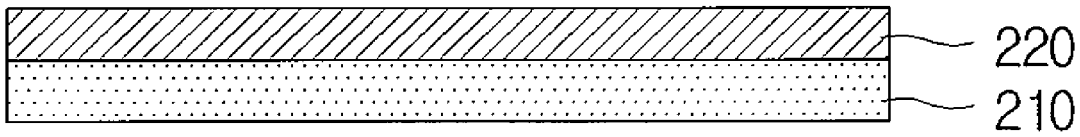

Then, as illustrated in FIG. 7B, a conductive layer 220 is formed on the insulation board 210 by using the normal pressure aerosol spray system. Here, copper particles with a diameter of about 5 um can be used to form the conductive layer 220, and it shall be apparent that metal particles having a variety of materials can be used. The conductive layer 220 being formed on the insulation board 210 can be formed in thickness between 1 um and 500 um, depending on the size of metal particles being used.

Figure 7C:
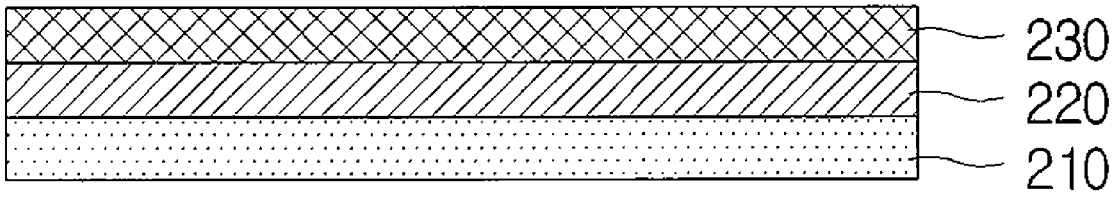

After that, as illustrated in FIG. 7C, a resistant layer 230 is formed on the conductive layer 220 by using the normal pressure aerosol spray system. In order to form the resistant layer 230, Ni/Cr particles having an average diameter of 0.45 μm can be used. In addition to the above, if necessary, it shall be apparent that a variety of electric resistant particles can be used. The resistant layer 230 can be formed in thickness between 1 um and 50 um, depending on the size of the resistant particles being used and the processing conditions.

Figure 7D:
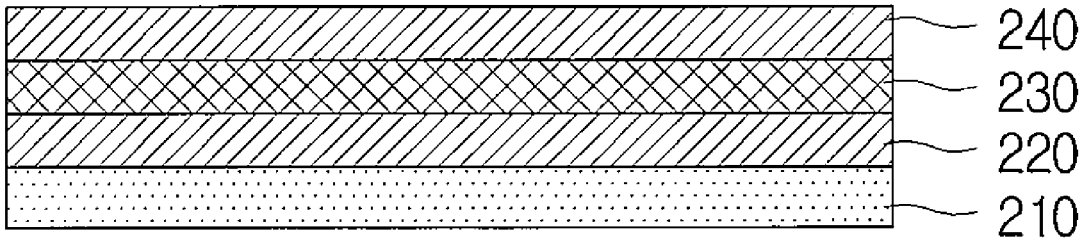

As illustrated in FIG. 7D, a conductive layer 240 can be formed on the resistant layer 230 so as to manufacture the embedded resistor board 200. At this time, the normal pressure aerosol spray system can be used for forming the conductive layer 140, and other methods, such as plating or evaporation, can be also used.

Although a method of forming the conductive layer 220 and the resistant layer 230 is disclosed by using the normal pressure aerosol spray system, as illustrated in FIG. 7, the embedded resistor board 200 can be also formed by forming a resistant layer on one surface of a conductive layer, for example, a copper clad laminate, which has been already formed, through the use of the normal pressure aerosol spray system.

Next, a method of manufacturing the embedded capacitor resistor board 300 can be briefly described by referring to FIG. 8.

Figure 8A:
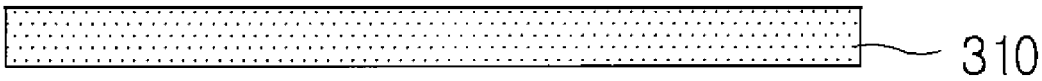

First, an insulation board 310 is prepared, as illustrated in FIG. 8A. A variety of insulation boards, from an insulation board of ceramics, for example, alumina oxides, to an epoxy plastic board charged with glass fibers, can be used as the insulation board 310.

Figure 8B:
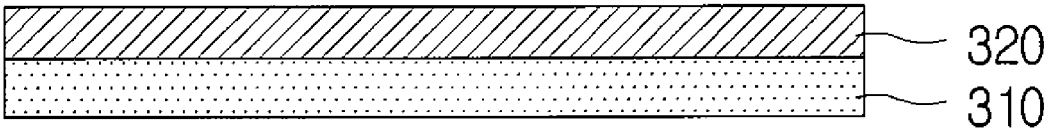

Then, as illustrated in FIG. 8B, a conductive layer 320 is formed on the insulation board 310 by using the normal pressure aerosol spray system. Here, copper particles with a diameter of about 5 um can be used to form the conductive layer 320, and it shall be apparent that metal particles having a variety of materials can be used. The conductive layer 320 being formed on the insulation board 310 can be formed in thickness between 1 um and 500 um, depending on the size of metal particles being used.

Figure 8C:
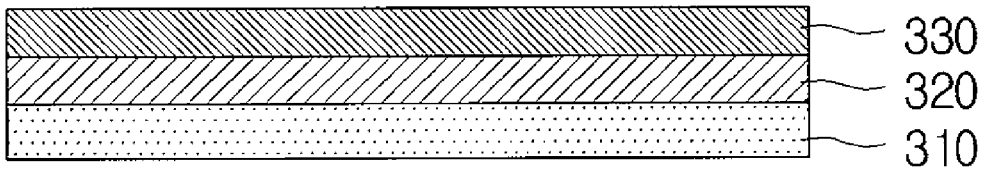

After that, as illustrated in FIG. 8C, a dielectric layer 330 is formed on the conductive layer 320 by using the normal pressure aerosol spray system. In order to form the dielectric layer 330, dielectric particles such as barium titanate particles can be used. In the present embodiment, $BaTiO_3$ particles having an average diameter of about 0.45 im are used. In addition to the above, if necessary, it shall be apparent that a variety of dielectric particles mixed with small amounts of additives can be used. The dielectric layer 330 can be formed in thickness between 1 um and 50 um, depending on the size of the dielectric particles being used and the processing conditions.

Figure 8D:
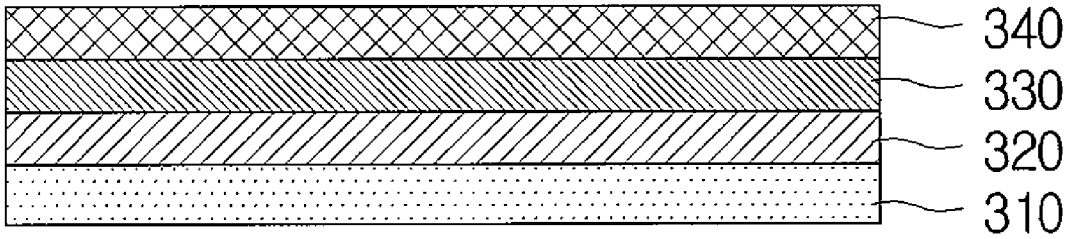

After that, as illustrated in FIG. 8D, a resistant layer 340 is formed on the dielectric layer 330 by using the normal pressure aerosol spray system. In order to form the resistant layer 340, Ni/Cr particles having an average diameter of 0.45 μm can be used. In addition to the above, if necessary, it shall be apparent that a variety of electric resistant particles can be used. The resistant layer 340 can be formed in thickness between 1 um and 50 um, depending on the size of the resistant particles being used and the processing conditions.

Figure 8E:
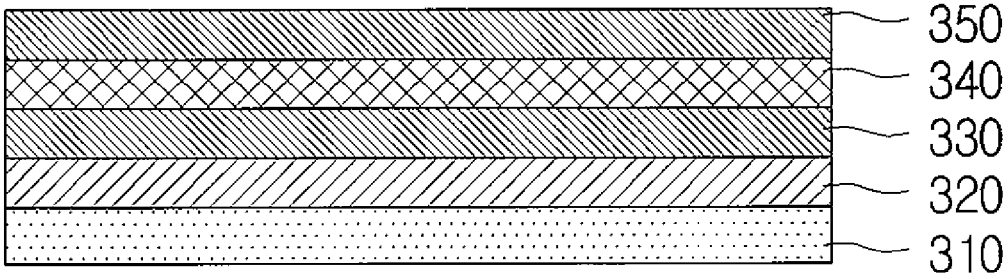

As illustrated in FIG. 8E, a conductive layer 350 can be formed on the resistant layer 340 so as to manufacture the embedded capacitor resistor board 300. At this time, the normal pressure aerosol spray system can be used for forming the conductive layer 350, and other methods, such as plating or evaporation, can be also used.

Although a method of forming the conductive layer 320, the dielectric layer 330 and the resistant layer 340 is disclosed by using the normal pressure aerosol spray system, which has been described earlier, as illustrated in FIG. 8, the embedded capacitor resistor board 300 can be also formed by forming a dielectric layer and a resistant layer on one surface of a conductive layer, for example, a copper clad laminate, which has been already formed, through the use of the normal pressure aerosol spray system.

While the spirit of the invention has been described in detail with reference to particular embodiments, the embodiments are for illustrative purposes only and shall not limit the invention. It is to be appreciated that those skilled in the art can change or modify the embodiments without departing from the scope and spirit of the invention. As such, many embodiments other than those set forth above can be found in the appended claims.

What is claimed is:

1. A method of forming a film on a surface of a board, the method comprising:

forming carrier gas by vaporizing liquefied gas;

increasing the pressure of the carrier gas;

forming an aerosol by mixing the carrier gas with powder;

generating remaining powder and impurities by forming the aerosol;

spraying the aerosol in a normal pressure environment such that the film is formed on the surface of the board;

providing a bypass valve; and discharging by the provided bypass valve the generated remaining powder and impurities, wherein forming the aerosol comprises:

mixing a first powder with the carrier gas;

mixing a second powder with the carrier gas; and mixing a first powder which is mixed with the carrier gas with a second powder which is mixed with the carrier gas.

2. The method of claim 1, further comprising, between the forming of the aerosol and the forming of the film, increasing the temperature of the aerosol.

3. The method of claim 1, wherein the liquefied gas consists of any one of nitrogen and inert gas.

4. The method of claim 1, wherein the increasing of the pressure of the carrier gas is performed such that a pressure range of the carrier gas is maintained between 1 atm and 7 atm.

5. The method of claim 1, wherein the powder consists of any one of metal and nonmetal.

6. The method of claim 5, wherein the metal consists of any one of copper and nickel.

7. The method of claim 5, wherein the nonmetal consists of a ceramic material.

8. A method of fabricating a passive device, the method comprising:

preparing a first conductive layer;

forming at least any one of a dielectric layer and a resistance layer on the first conductive layer; and forming a second conductive layer on the dielectric layer or the resistance layer, wherein the forming of the dielectric layer or resistance layer comprises:

forming carrier gas by vaporizing liquefied gas;

increasing the pressure of the carrier gas;

forming a first aerosol by mixing the carrier gas with dielectric powder or resistance powder;

generating remaining powder and impurities by forming the first aerosol;

spraying the first aerosol onto a surface of the first conductive layer in a normal pressure environment;

providing a bypass valve; and discharging by the provided bypass valve the generated remaining powder and impurities, wherein forming the aerosol comprises:

mixing a first powder with the carrier gas;

mixing a second powder with the carrier gas; and mixing a first powder which is mixed with the carrier gas with a second powder which is mixed with the carrier gas.

9. The method of claim 8, further comprising, after the forming of the first aerosol, increasing the temperature of the first aerosol.

10. The method of claim 8, wherein the liquefied gas consists of any one of nitrogen and inert gas.

11. The method of claim 8, wherein the preparing of the first conductive layer comprises:

forming carrier gas by vaporizing liquefied gas;

increasing the pressure of the carrier gas;

forming a second aerosol by mixing the carrier gas with conductive powder; and spraying the second aerosol onto a surface of an insulation board in a normal pressure environment.

12. An aerosol spray apparatus for forming a film on a surface of a board, the apparatus comprising:

a carrier gas injection unit configured to form carrier gas by vaporizing liquefied gas and to increase the pressure of the carrier gas;

an aerosol forming unit configured to form an aerosol by mixing the carrier gas with powder and to generate remaining powder and impurities therein by forming the aerosol;

a film forming unit configured to spray the aerosol in a normal pressure environment such that the film is formed on the surface of the board; and a bypass valve configured to discharge the generated remaining powder and impurities from the aerosol forming unit, wherein the aerosol forming unit comprises:

a first powder supply device configured to supply a first powder;

a first gas control valve configured to control an influx of the carrier gas being supplied to the first powder supply device;

a first powder control valve configured to control the first powder being sprayed from the first powder supply device;

a second powder supply device configured to supply a second powder;

a second gas control valve configured to control an influx of the carrier gas being supplied to the second powder supply device; and a second powder control valve configured to control the second powder being sprayed from the second powder supply device.

13. The aerosol spray apparatus of claim 12, further comprising a heating unit being interposed between the aerosol forming unit and the film forming unit and configured to increase the temperature of the aerosol supplied from the aerosol forming unit.

14. The aerosol spray apparatus of claim 12, wherein the liquefied gas consists of any one of nitrogen and inert gas.

15. The aerosol spray apparatus of claim 12, wherein the carrier gas injection unit maintains a pressure range of the carrier gas between 1 atm and 7 atm.

16. The aerosol spray apparatus of claim 12, wherein the powder consists of any one of metal and nonmetal.

17. The aerosol spray apparatus of claim 16, wherein the metal consists of any one of copper and nickel.

18. The aerosol spray apparatus of claim 16, wherein the nonmetal consists of a ceramic material.

19. The aerosol spray apparatus of claim 12, wherein the film forming unit comprises:

a chamber;

a spray unit being mounted inside the chamber and configured to spray the aerosol; and a position control unit configured to control a position of a board, the aerosol sprayed from the spray unit being deposited on the position of the board.

20. The aerosol spray apparatus of claim 19, further comprising a hot plate being coupled to the position control unit, the board being mounted on the hot plate.

21. The aerosol spray apparatus of claim 19, wherein the spray unit is a nozzle orifice with a diameter of 1.0 to 4.5 mm.

22. The aerosol spray apparatus of claim 21, wherein the spray speed of the spray unit is determined by the size of the nozzle orifice and the pressure of the carrier gas injection unit.

* * * * *